US007516912B2

(12) United States Patent
Schmitz et al.

(10) Patent No.: US 7,516,912 B2
(45) Date of Patent: Apr. 14, 2009

(54) SWING HAMMER FOR PARTICULATE SIZE REDUCTION SYSTEM

(75) Inventors: William Schmitz, Clymer, NY (US); Daniel P. Smith, Spencer, MA (US); Craig A. Penterson, Sutton, MA (US)

(73) Assignee: Riley Power, Inc., Worcester, MA (US)

( * ) Notice: Subject to any disclaimer, the term of this patent is extended or adjusted under 35 U.S.C. 154(b) by 81 days.

(21) Appl. No.: 11/744,081

(22) Filed: May 3, 2007

(65) Prior Publication Data

US 2008/0272217 A1 Nov. 6, 2008

(51) Int. Cl.
*B02C 13/28* (2006.01)

(52) U.S. Cl. ..... 241/194; 241/197; 241/300

(58) Field of Classification Search ..... 241/194, 241/197, 300

See application file for complete search history.

(56) References Cited

U.S. PATENT DOCUMENTS

| | | | |
|---|---|---|---|
| 1,628,609 | A | 5/1927 | Newhouse |
| 2,625,332 | A | 1/1953 | Rogers et al. |
| 2,628,038 | A | 2/1953 | Rogers et al. |
| 2,639,863 | A | 5/1953 | Rogers |
| 3,050,018 | A | 8/1962 | Pearson |
| 3,092,337 | A | 6/1963 | Patterson |
| 4,919,795 | A | 4/1990 | Fujii et al. |
| 5,025,930 | A | 6/1991 | Barthelmess |
| 5,289,978 | A | 3/1994 | Lundquist |
| 5,348,272 | A | 9/1994 | Lukstas et al. |
| 5,560,550 | A | 10/1996 | Krawczyk |
| 5,938,045 | A | 8/1999 | Makino et al. |
| 6,443,376 | B1 | 9/2002 | Huang et al. |
| 6,644,479 | B1 | 11/2003 | Kimmeyer et al. |
| 7,377,459 | B2 * | 5/2008 | Potts ..... 241/197 |

* cited by examiner

*Primary Examiner*—Mark Rosenbaum
(74) *Attorney, Agent, or Firm*—Edwards Angell Palmer & Dodge LLP

(57) ABSTRACT

The invention provides a particulate size reduction system including a grinding chamber, a center shaft defining an axis of rotation and configured for rotational motion within the grinding chamber, a wheel assembly mounted on the center shaft and at least one swing hammer mounted on the wheel assembly. The at least one swing hammer preferably includes a base portion having a first end having a mounting portion for attachment to a wheel assembly of a material treatment system, a second end, an inboard portion proximate the mounting and an outboard portion proximate the second end. The swing hammer also preferably includes a wear pad disposed on the base portion. The wear pad preferably substantially covers a face of the base portion. The wear pad preferably extends from a point proximate the second end of the base portion toward the first end of the base portion to a location proximate the mount.

20 Claims, 9 Drawing Sheets

FIG. 1
(PRIOR ART)
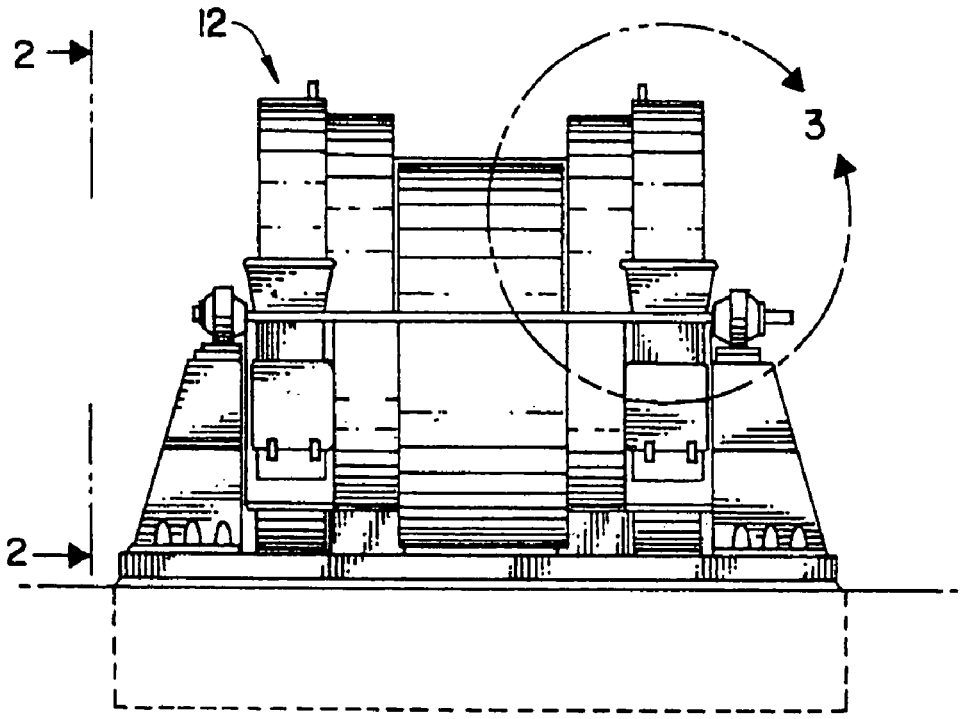
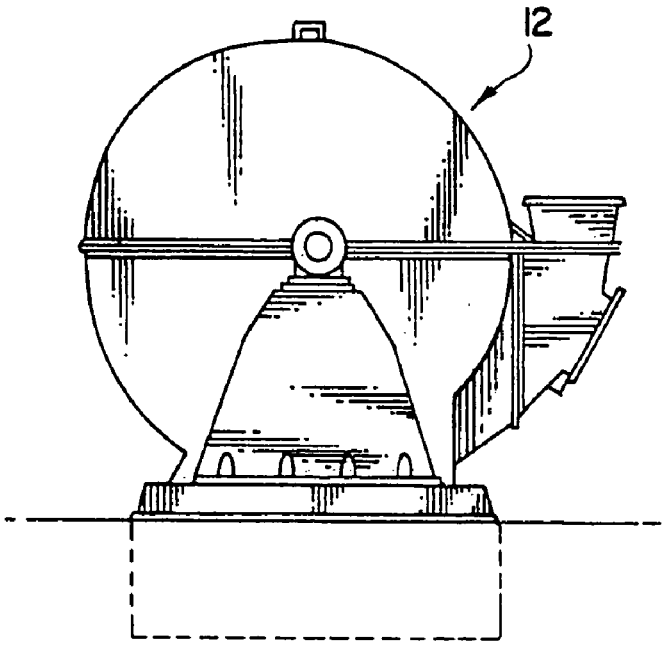
FIG. 2
(PRIOR ART)

SWING HAMMER FOR PARTICULATE SIZE REDUCTION SYSTEM

BACKGROUND OF THE INVENTION

1. Field of the Invention

The present invention relates to methods and systems for material treatment, such as particulate size reduction. Particularly, the present invention is directed to methods and systems for material size reduction that are useful in coal technology.

2. Description of Related Art

In operations that use coal for fuel, finely-ground coal particles or "fines" are required for efficient operation, yielding higher combustion efficiency than stoker firing, as well as rapid response to load changes. Using coal fines for combustion has the potential for less nitrous oxide ($NO_x$) emissions and keeps oversized loss-on-ignition (LOI) unburned coal particles from contaminating the marketable ash byproduct of the combustion chamber. Thus, it is common practice to supply raw coal to a device, such as a pulverizer, that will reduce the size of the coal to particles within a desirable size range prior to being conveyed to the furnace for combustion.

Many pulverizers employ systems and methods including one or more crushing and grinding stages for breaking up the raw coal. Coal particles are reduced by the repeated crushing action of rolling or flailing elements to dust fine enough to become airborne in an air stream swept through the pulverizer. The dust particles are entrained in the air stream and carried out for combustion.

It should be readily apparent that the process of reducing solid coal to acceptably sized fines requires equipment of high strength and durability. Therefore, there exists a continuing need for crushing and grinding components which can reduce solid coal to acceptably sized fines in less time with greater efficiency, and in a manner which results increased wear life for those components. The present invention provides a solution for these problems.

SUMMARY OF THE INVENTION

The purpose and advantages of the present invention will be set forth in and become apparent from the description that follows. Additional advantages of the invention will be realized and attained by the methods and systems particularly pointed out in the written description and claims hereof, as well as from the appended drawings.

To achieve these and other advantages and in accordance with the purpose of the invention, as embodied herein, the invention includes a swing hammer for fastening on a crusher rotor assembly or wheel of a material size reducing and drying system. The crusher rotor assembly is preferably mounted on a center shaft of the system, wherein the center shaft defines an axis of rotation and is configured for rotational motion within a process chamber of the material size reducing system.

In accordance with one embodiment of the invention, the swing hammer is made at least in part from a ductile impact absorbing backing material defining a hammer face. Preferably, a wear resistant material is bonded to the hammer, such as to the hammer face. The backing material absorbs impact for the wear resistant material. The wear resistant material can take on a variety of forms, such as a wear pad that is formed separately and bonded to the hammer face, among others. The wear resistant material protects the softer backing material from wear during the crushing and/or drying process.

The hammer can be made in a variety of ways. Preferably, the hammer is made by way of a forging operation. The hammer is preferably shaped so that it fits over and within a lug on the crusher rotor. The crusher rotor may be fastened to the rotating assembly by way of a crusher rotor spacer. Both the crusher rotor and hammer may have the same size hole drilled through them. The hammer preferably has two holes per lug and the crusher rotor preferably has one hole per lug. In accordance with one embodiment, the swing hammer of the invention is attached to the crusher rotor by way of a hammer pin. The hammer pin may be held in place, for example, by a cotter pin positioned in a hole on the crusher rotor lug.

It is to be understood that both the foregoing general description and the following detailed description are exemplary and are intended to provide further explanation of the invention claimed.

The accompanying drawings, which are incorporated in and constitute part of this specification, are included to illustrate and provide a further understanding of the method and system of the invention. Together with the description, the drawings serve to explain the principles of the invention.

BRIEF DESCRIPTION OF THE DRAWINGS

So that those having ordinary skill in the art to which the present invention pertains will more readily understand how to make and use the present invention, an embodiment thereof will be described in detail with reference to the drawings, wherein:

FIG. 1 is a front view of an exemplary rotary coal pulverizer (duplex model) which can employ a plurality of swing hammers constructed in accordance with the present invention mounted therein.

FIG. 2 is a side view of the rotary coal pulverizer of FIG. 1, illustrating the discharge from the fan section of the pulverizer.

DETAILED DESCRIPTION OF THE PREFERRED EMBODIMENT

Reference is now made to the figures and accompanying detailed description which have been provided to illustrate exemplary embodiments of the present invention, but are not intended to limit the scope of embodiments of the present invention. Although a particular type of particulate size reduction system is shown in the figures and discussed herein, it should be readily apparent that a device or system constructed in accordance with the present invention can be employed in a variety of other systems, or other applications that do not involve coal as the raw material. In other words, the specific particulate size reduction processes illustrated herein are not vital to gaining the benefits associated with using a system constructed in accordance with the present invention.

FIGS. 1 and 2 illustrate the general location of a presently preferred embodiment of a swing hammer constructed in accordance with the present invention and employed in an exemplary rotary coal pulverizer 12, from the exterior of pulverizer 12. Pulverizer 12 is known as a horizontal type high speed coal mill and is closely based on a duplex model ATRITA® pulverizer sold commercially by Babcock Power Inc. However, this should not be interpreted as limiting the present invention in any way, as many types of pulverizing devices employ similar elements and are suitable for use with the present invention.

The duplex model is essentially two single models side by side. It should be readily apparent that a swing hammer constructed in accordance with the present invention may also be disposed in a single model. For purposes of ease and convenience in describing the features of the present invention, only a single side of the duplex model is discussed herein.

Figure 3:
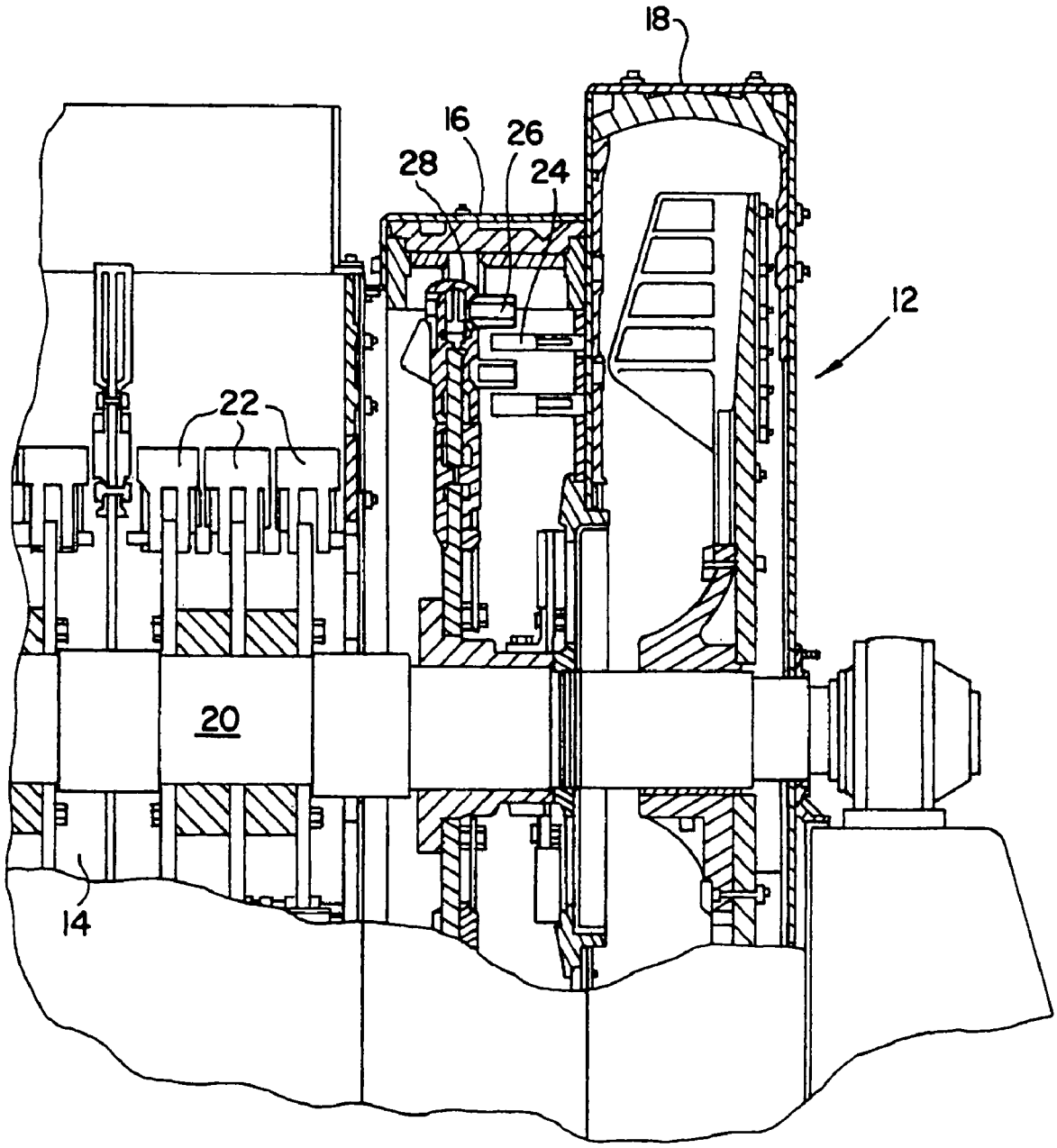
FIG. 3 (PRIOR ART)
FIG. 3 is an enlarged localized partial cross-sectional view of a portion of the exemplary rotary coal pulverizer of FIG. 1, illustrating a prior art swing hammer positioned on the wheel assembly in the crusher section.

As can be seen in FIG. 3, pulverizer 12 includes a crusher-dryer section 14, a grinding section 16 and a fan section 18. A center shaft 20 extends through the pulverizer 12 and defines an axis of rotation. Thus, terms used herein, such as "radially outer" and "radially inner," therefore refer to the relative distance in a perpendicular direction from the axis defined by center shaft 20, while "axially inner" and "axially outer" refer to the distance along or parallel to the axis defined by center shaft 20, wherein the "axially innermost" section in pulverizer 12 is crusher-dryer section 14.

Raw coal and primary air enter the crusher-dryer section 14. Prior art swing hammers 22 mounted on and driven by center shaft 20, along with impact liners (not shown), operate to crush the coal against a breaker plate, a crusher block and an array of grids (not shown). High temperature primary air is used to flash dry a good deal of the surface moisture of the coal, which helps prepare the coal for combustion. As the high-temperature primary air evaporates moisture from the coal, the temperature of the coal-air mixture is reduced, which significantly reduces the risk of fires within the pulverizer.

When coal passes through the grid of the crusher-dryer section 14, it enters the axially outer adjacent grinding section 16. The major grinding components in grinding section 16 include stationary pegs 24 and clips 26 disposed on a rotating disc or wheel assembly 28.

Figure 4A:
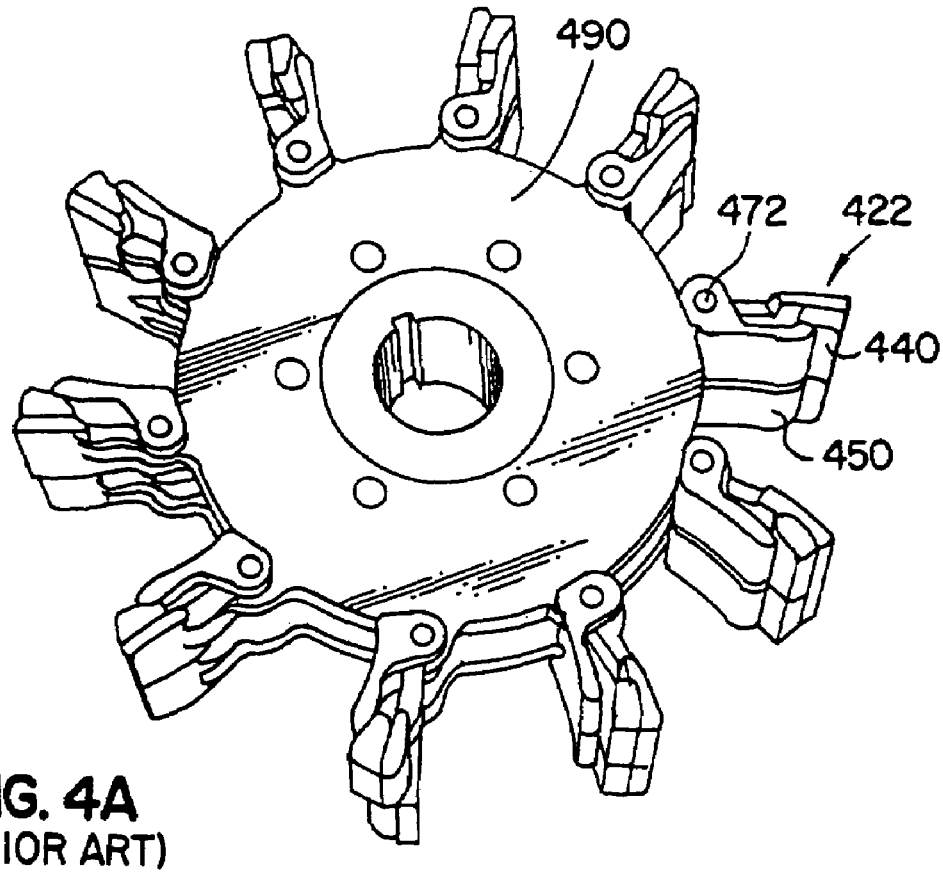
FIG. 4A (PRIOR ART)
FIGS. 4(A)-4(B) depict a first embodiment of a two-piece prior art swing hammer with a guard.
Figure 4B:
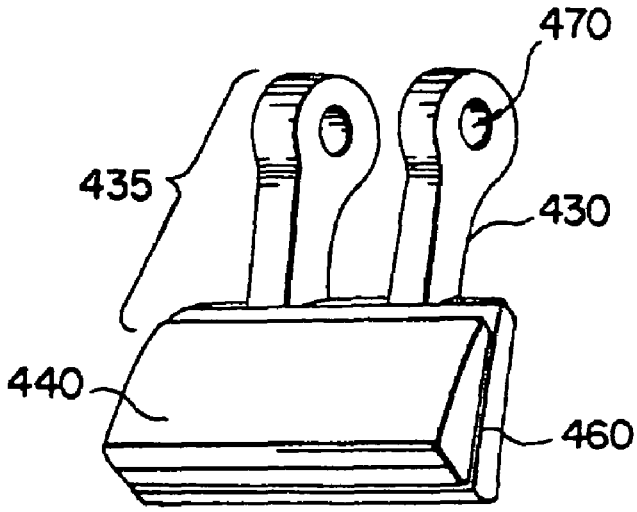
FIG. 4B ( PRIOR ART)

FIGS. 4(A)-4(B) illustrate a plurality of prior art hammers 422. FIG. 4(A) illustrates a plurality of prior art swing hammers 422 positioned on a wheel 490. Wheel 490 is adapted and configured to be mounted on a center shaft of a coal pulverizer, as described herein. Two piece hammer 422 is made from a base portion 430 (such as a forging), a pad 440, and a guard 450. FIG. 4(B) illustrates a close up view of the hardened pad 440 mounted on the base portion 430, including mounting holes 470 defined in base portion 430. The base portion 430 is preferably made from a ductile material to absorb impact when crushing coal. The hardened pad 440 resists wear during the crushing process. The hammer guard 450 protects the softer, inboard portion 435 of base portion 430 and the bonding joint 460 that joins the pad 440 to the base portion 430. Base portion 430 and guard 450 are rotatably mounted to wheel 490 by way of a pin or bolt 472. A significant disadvantage of this design is that it is necessary to stock two parts—the combined base portion 430 and wear pad 440, as well as the guard 450.

Figure 5:
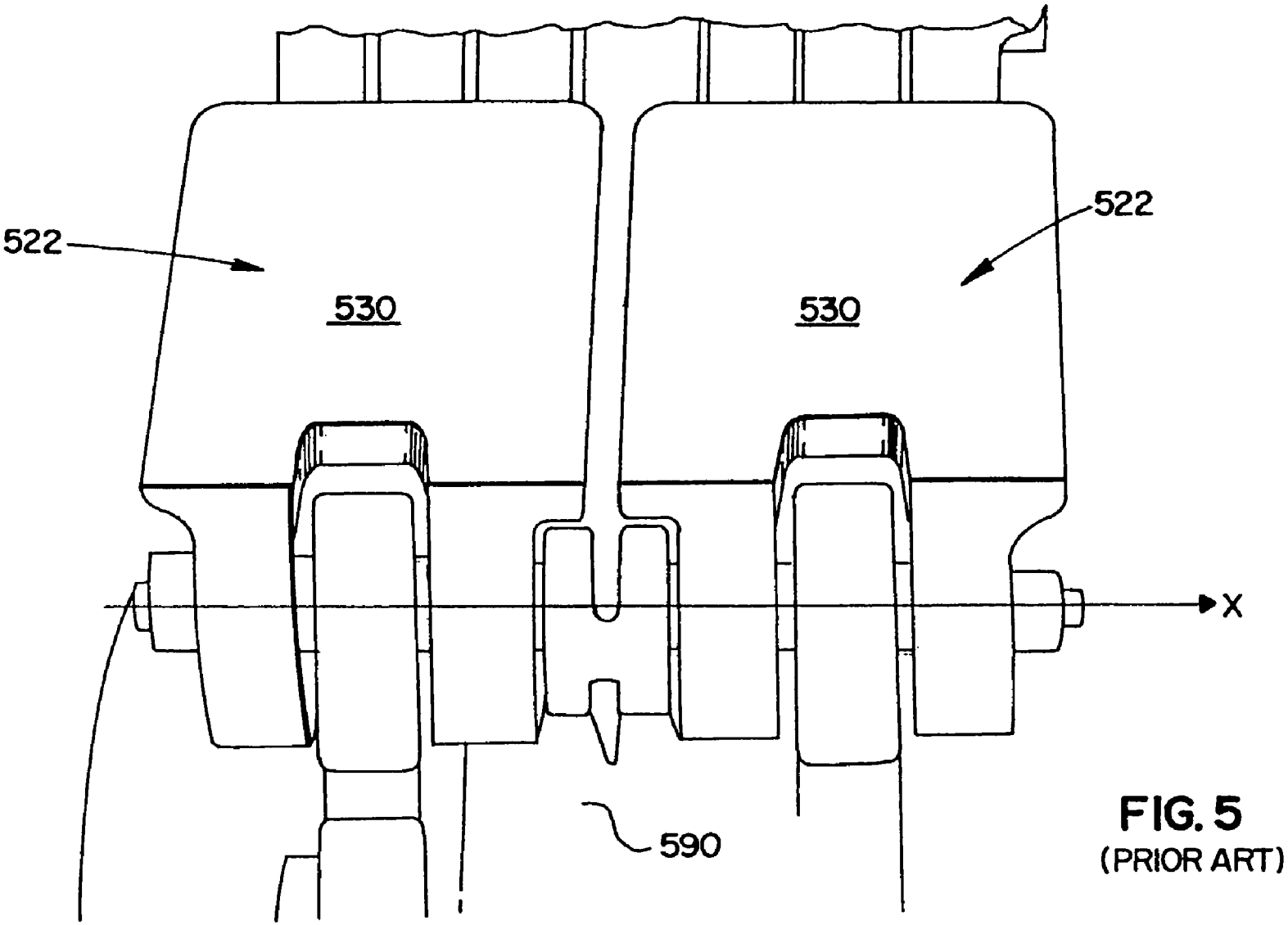
FIG. 5 (PRIOR ART)
FIG. 5 depicts a second embodiment of a one-piece prior art swing hammer without a guard.

FIG. 5 illustrates a second, prior art one-piece hammer 522 having a face 530 for impacting coal or other material mounted on a wheel 590 inside of a coal pulverizer. Hammer 522 is rotatably mounted to wheel 590 to pivot about an axis X. Hammer 522 is generally made as a one piece casting from a material such as Manganese steel (approximately 240 BHN) or stainless steel. A hardness rating for the cast stainless steel is not presently available.

While the prior art hammer depicted in FIG. 5 does exhibit significant resistance to wear, the two piece hammer of FIG. 4 has been found to have at least twice the wear life of the one piece hammer depicted in FIG. 5. This is possible due to the increased wear resistance.

In accordance with the invention, swing hammers are provided herein that address problems in the prior art swing hammers described above.

Figure 6A:
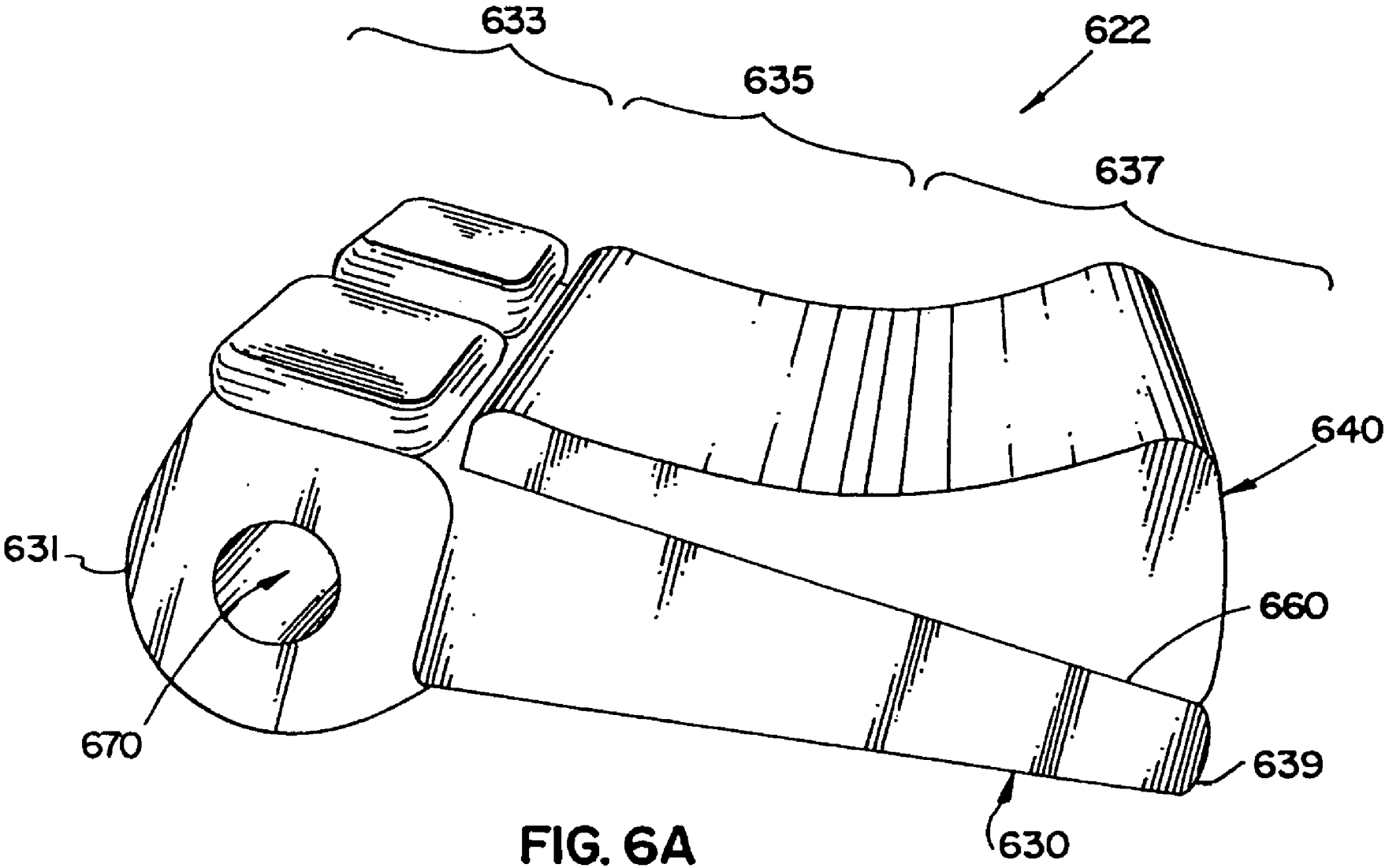
FIGS. 6(A)-6(C) depict perspective, front and side views of a first representative embodiment of a swing hammer made in accordance with the invention, respectively.
Figure 6C:
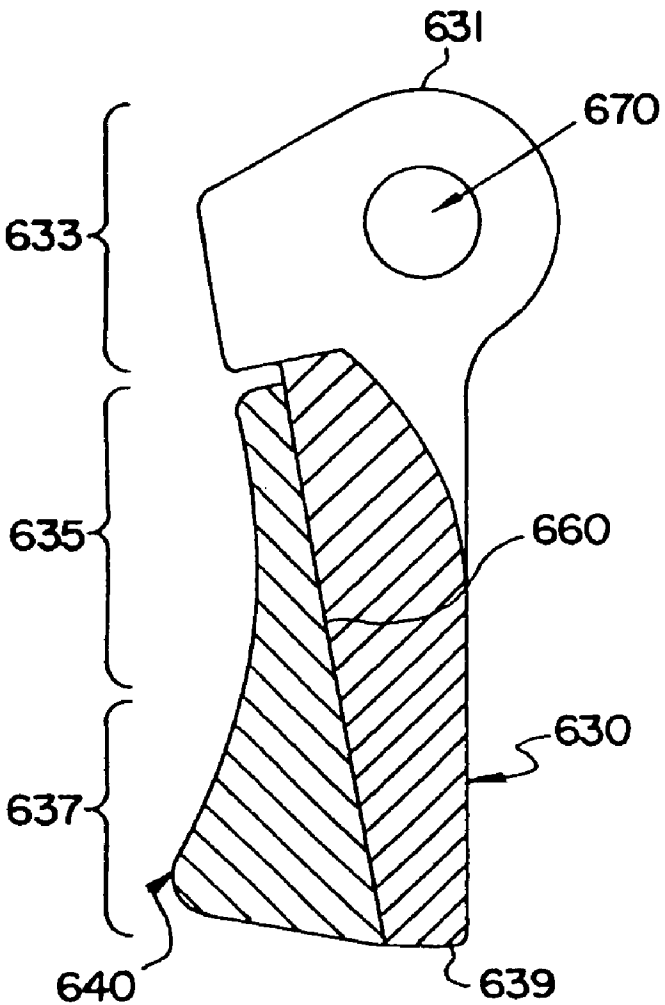
Figure 6B:
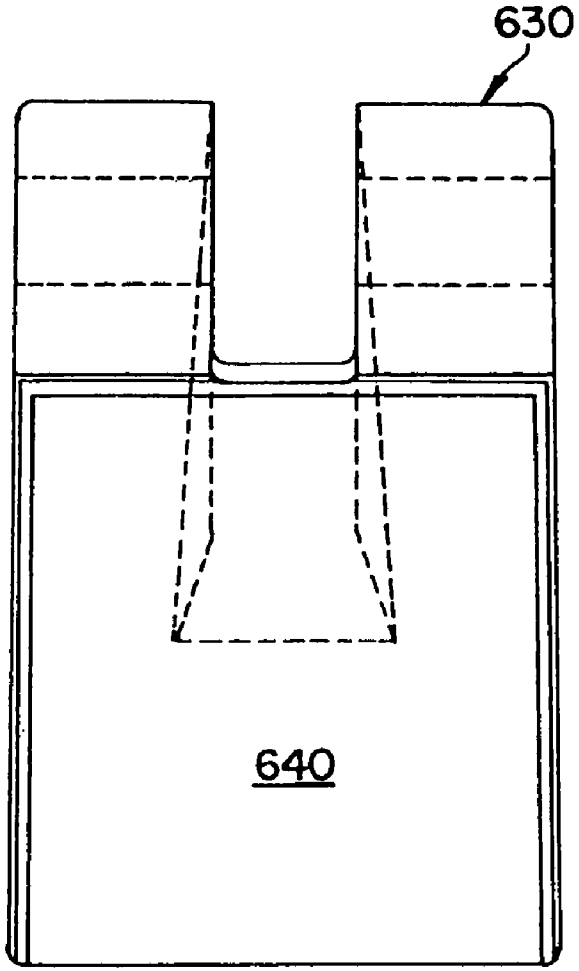

For purposes of illustration and not limitation, as embodied herein and as depicted in FIGS. 6(A)-6(C), a first representative embodiment of a swing hammer 622 made in accordance with the invention is depicted. FIG. 6(A) depicts a perspective view of hammer 622. FIGS. 6(B) and 6(C) depict front and side plan views of hammer 622, respectively. Swing hammer 622 includes a first end 631 having a mounting portion 633, a second end 639, an inboard portion 635 and an outboard portion 637. As depicted, hammer 622 includes a wear pad 640 attached to a base portion 630 at joint 660. Wear pad 640 may be attached to base portion 630 in a variety of ways, such as soldering, brazing and the like. In accordance with a preferred embodiment, wear pad 640 is attached to base portion 630 by way of a silver solder material. As with the previously presented swing hammers 422, 522, hammer 622 includes a mounting portion including a mounting hole 670. Base portion 630 and pad 640 are normally formed as a ductile forging and casting, respectively.

As can be seen, the wear pad 640 is significantly longer than the wear pad 440 depicted in the prior art swing hammer 422 of FIG. 4, and extends toward mounting hole 670, over inboard portion 635 of swing hammer 622. Wear pad 640 has accordingly been shown to help protect the inboard portion 635 of swing hammer, thereby eliminating the need for a separate guard (e.g., 450) as in the embodiment 422 depicted in FIGS. 4(A)-4(B). By providing a one-piece swing hammer 622 and forming the pad material in a more wear resistant material it is possible to have a one piece swing hammer construction that is easier to install, and that is more durable than swing hammers of the prior art.

Figure 7:
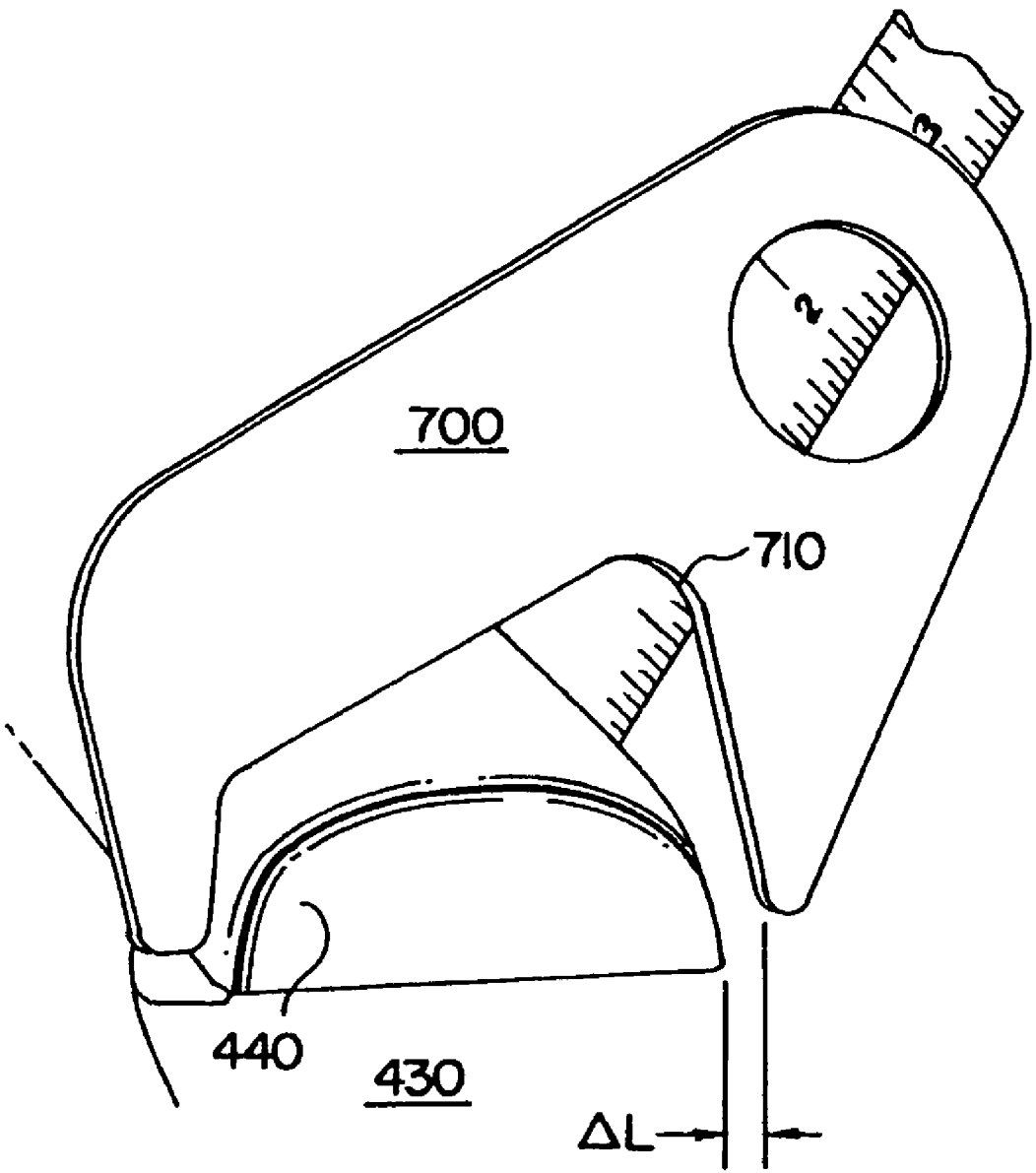
FIG. 7 depicts wear performance of the prior art swing hammer depicted in FIGS. 4(A)-4(B), using a template.
Figure 8:
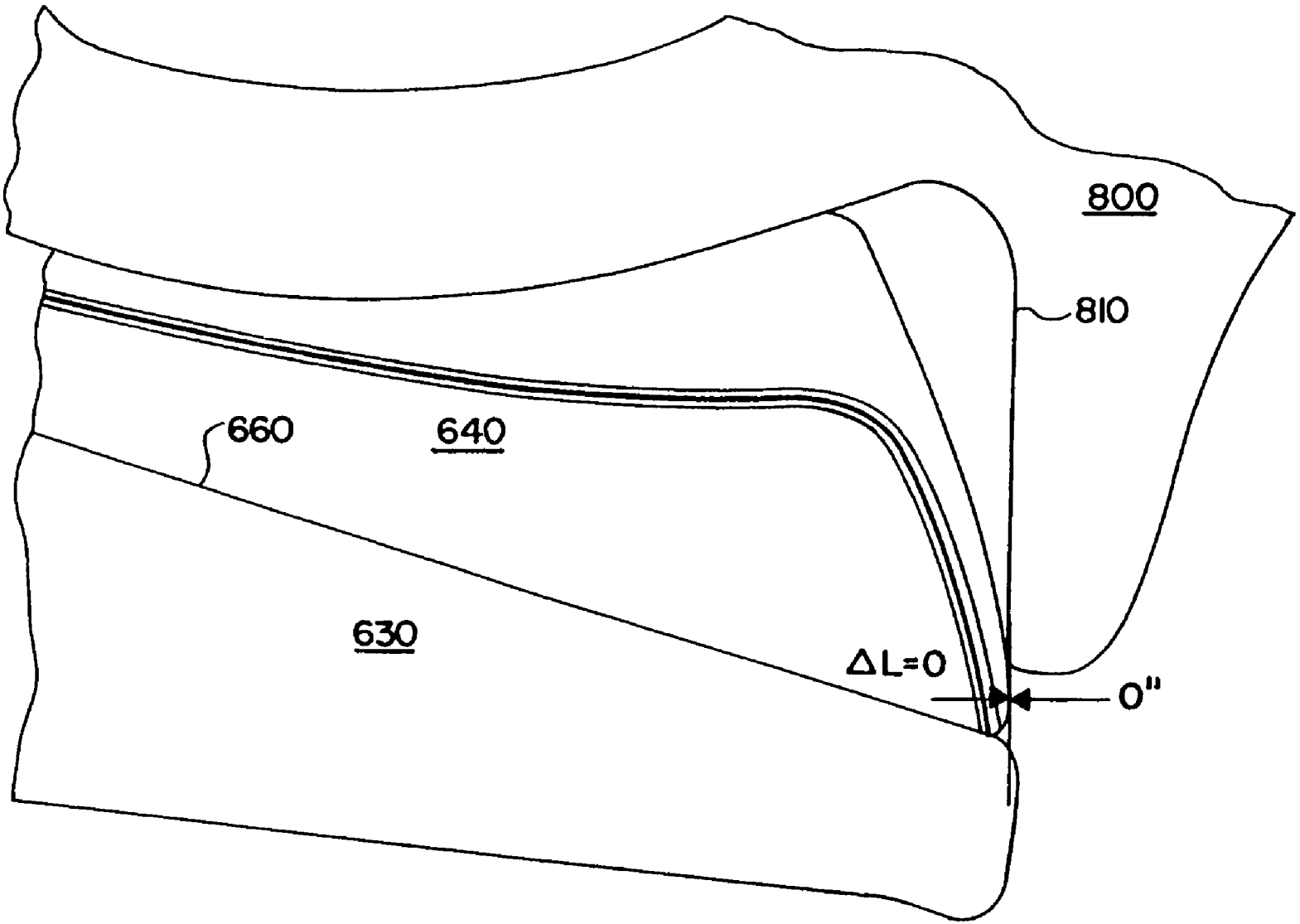
FIG. 8 depicts wear performance of the swing hammer made in accordance with the invention depicted in FIGS. 6(A)-6(C), using a template.

FIGS. 7 and 8 depict the results of wear tests of the prior art hammer 422 with guard 450 (FIG. 7) as compared to a hammer 622 made in accordance with the invention (FIG. 8). In each case, the hammers 422, 622 were operated in a coal pulverizer through six months of typical operation. As depicted in FIG. 7, a measuring fixture 700 having a profile 710 corresponding to an unused hammer 422 reveals significant wear of the wear pad.

Significantly, the length of the swing hammer was actually reduced by three-sixteenths of an inch. This is very problematic, as reduction of the length of a swing hammer significantly reduces the effectiveness of the coal pulverizer. For the particular hammer 422 depicted in FIG. 7, pad 440 is made from an abrasion resistant cast iron material having a Brinnell hardness ("BHN") of about 600-650. Base portion 430 is made from steel, having a BHN of about 200-255.

In contrast, as depicted in FIG. 8, significantly less wear is shown on swing hammer 622, when comparing swing hammer with its originally installed profile 810 defined by measuring fixture 800. Most importantly, the length of swing hammer 622 did not change during use, thereby not leading to a decrease in the efficacy of the coal pulverizer. For the particular hammer 622 depicted in FIG. 8, pad 640 is made from an abrasion resistant cast iron material having a Brinnell hardness ("BHN") of about 700-750. Base portion 430 is made from steel, having a BHN of about 200-255, as with the embodiment of FIG. 7.

As will be appreciated by those of skill in the art, the diverging results depicted in FIGS. 7-8 are actually quite dramatic.

Figure 9:
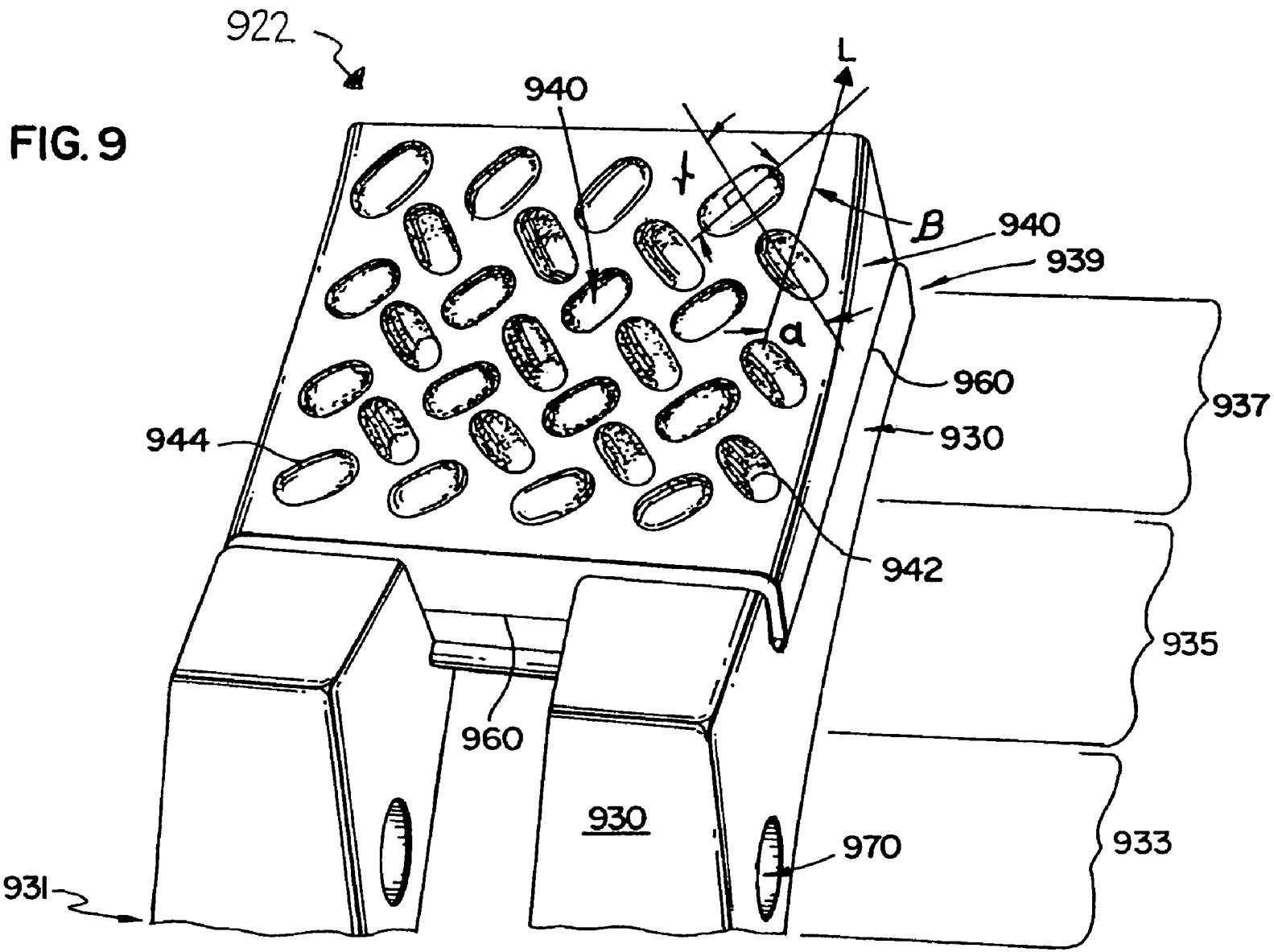
FIG. 9 depicts a second representative embodiment of a swing hammer made in accordance with the invention.

For purposes of further illustration and not limitation, a second embodiment of a swing hammer 922 made in accordance with the invention is depicted in FIG. 9. Swing hammer 922 includes a first end 931 having a mounting portion 933, a second end 939, an inboard portion 935 and an outboard portion 937. Swing hammer 922 includes a base portion 930 which may be forged, and a wear pad 940. A significant difference between the embodiment of FIG. 9 and that of FIG. 6 is that pad 940 includes an interrupted surface defined by a plurality of raised surfaces 942, 944. As depicted, a first set of elongated raised surfaces 942 are provided that are oriented at an angle $\alpha$ with respect to a longitudinal axis L of hammer 922. Similarly, a second set of elongated raised surfaces 944 are oriented at an angle $\beta$ with respect to axis L. As depicted, the elongated raised surfaces are further oriented at a third angle $\gamma$ with respect to each other. It will be appreciated that surfaces 942, 944 can be oriented at any angle with respect to each other and the pad 940.

The embodiment of FIG. 9 may be made from a variety of materials, as described herein. For example, the particular hammer 922 depicted in FIG. 9 includes a forged base portion 930 made from steel, similar to the embodiments of FIGS. 4 and 6. The wear pad 940 may be made from a harder material, such as wear resistant cast iron. Wear pad 940 may be attached to base portion 930 in any suitable manner, such as brazing and the like. The description of materials of construction herein is considered to merely be exemplary and illustrative, and not limiting. For example, if desired, the hammers 622 and 922 depicted herein may be formed from a single material in a single forging operation. However, a two piece construction is preferred to permit portion 939 to be made from a softer, resilient material and the pad made from a high wear resistant material. Moreover, it will be appreciated that the different portions of swing hammers depicted herein may be made from a variety of techniques, such as casting, forging (e.g., ductile forging), and the like.

It will be appreciated that a variety of materials can be used to make the wear pad portion of swing hammers made in accordance with the invention. Suitable materials may include, for purposes of illustration only, ASTM A532 Class I, Type A Abrasion Resistant Cast Iron, 500 BHN minimum with 1.4-4% Cr and/or ASTM A532, Class II, Type B Abrasion Resistant Cast Iron, 550-600 BHN, with 14-18% Cr, among others. The base portions of hammers made in accordance with the invention may also be made from a variety of materials. Such materials may include, for example, ASTM A128 Grade A, Cast Manganese Steel, 240 BHN maximum, minimum 11% Mn and/or ASTM A743 Grades CF-8, CF-20, Cast Stainless Steel, 18-21% Cr, 8% Ni, among others.

Without wishing to be limited to a particular theory, it is presently believed that the texturing on the hammer pad of FIG. 9 reduces wear by deflecting coal particles off of the hammer pad surface and exposing less pad surface area to be impacted by coal particles. As such, it is believed that the textured pad 940 helps to reduce wear on the pad surface. As will be appreciated, the depiction of raised surfaces 942, 944 is merely exemplary. Raised surfaces of any suitable shape may be used, such as round, triangular, rectangular and the like. Similarly, such raised surfaces may be arranged into any suitable pattern or may be arranged randomly. Similarly, an interrupted surface may be formed by forming a plurality of depressions of various shapes in pad 940 instead of or in addition to raised surfaces, as desired.

Although exemplary and preferred aspects and embodiments of the present invention have been described with a full set of features, it is to be understood that the disclosed system and method may be practiced successfully without the incorporation of each of those features. For example, many industries include applications that utilize raw materials that are first broken up into relatively small sized particles. Accordingly, the raw materials are fed into devices that employ one or more physical processes to reduce the size of the raw material prior to their use. A swing hammer constructed according to the present invention can be utilized for such purposes. Thus, it is to be further understood that modifications and variations may be utilized without departure from the spirit and scope of this inventive system and method, as those skilled in the art will readily understand. Such modifications and variations are considered to be within the purview and scope of the appended claims and their equivalents.

What is claimed is:

1. A swing hammer for a particulate size reduction system, comprising:

a) a base portion having:

i) a first end having a mounting portion for attachment to a wheel assembly of a particulate size reduction system;

ii) a second end;

iii) an inboard portion proximate the mounting portion; and iv) an outboard portion proximate the second end; and b) a wear pad disposed on the base portion, the wear pad substantially covering a face of the base portion, the wear pad extending from a point proximate the second end of the base portion toward the first end of the base portion to a location proximate the mount, wherein the wear pad substantially covers the inboard portion of the base portion.

2. The swing hammer of claim 1, wherein the wear pad is bonded to the base portion from a material selected from the group consisting of (i) brazing, (ii) soldering, (iii) welding and combinations thereof.

3. The swing hammer of claim 1, wherein the wear pad and base portion are forged from a single piece of material.

4. The swing hammer of claim 1, wherein the base portion is made from steel.

5. The swing hammer of claim 1, wherein the wear pad is made from an abrasion resistant cast iron.

6. A particulate size reduction system comprising:

a) a grinding chamber;

b) a center shaft defining an axis of rotation and configured for rotational motion within the grinding chamber;

c) a wheel assembly mounted on the center shaft; and d) at least one swing hammer mounted on the wheel assembly, the at least one swing hammer including:

i) a base portion having:

(1) a first end having a mounting portion for attachment to a wheel assembly of a particulate size reduction system;

(2) a second end;

(3) an inboard portion proximate the mounting portion; and (4) an outboard portion proximate the second end; and ii) a wear pad disposed on the base portion, the wear pad substantially covering a face of the base portion, the wear pad extending from a point proximate the second end of the base portion toward the first end of the base portion to a location proximate the mount, wherein the wear pad substantially covers the inboard portion of the base portion.

7. The particulate size reduction system of claim 6, wherein the wear pad is bonded to the base portion from a material selected from the group consisting of (i) brazing, (ii) soldering, (iii) welding and combinations thereof.

8. The particulate size reduction system of claim 6, wherein the wear pad and base portion are forged from a single piece of material.

9. The particulate size reduction system of claim 6, wherein the base portion is made from steel.

10. The particulate size reduction system of claim 6, wherein the wear pad is made from an abrasion resistant cast iron.

11. The swing hammer of claim 1, wherein the wear pad is bonded to the base portion by a solder material including silver.

12. The swing hammer of claim 1, wherein the base portion is a ductile forging and the wear pad is a casting.

13. The swing hammer of claim 1, wherein the wear pad has a Brinell hardness of about 700 to about 750.

14. The swing hammer of claim 1, wherein the base portion has a Brinell hardness of about 200 to about 255.

15. The particulate size reduction system of claim 6, wherein the swing hammer is attached to the wheel assembly by way of a hammer pin.

16. The particulate size reduction system of claim 6, wherein the system is adapted and configured to pulverize coal.

17. The particulate size reduction system of claim 6, wherein the wear pad of the hammer is bonded to the base portion of the hammer by a solder material including silver.

18. The particulate size reduction system of claim 6, wherein the base portion of the hammer is a ductile forging and the wear pad of the hammer is a casting.

19. The particulate size reduction system of claim 6, wherein the wear pad of the hammer has a Brinell hardness of about 700 to about 750.

20. The particulate size reduction system of claim 6, wherein the base portion of the hammer has a Brinell hardness of about 200 to about 255.

* * * * *